United States Patent [19]

Gray

[11] Patent Number: 4,616,499

[45] Date of Patent: Oct. 14, 1986

[54] ISOTHERMAL FORGING METHOD

[75] Inventor: Robert M. Gray, Atlanta, Ga.

[73] Assignee: Lockheed Corporation, Calabasas, Calif.

[21] Appl. No.: 788,359

[22] Filed: Oct. 17, 1985

[51] Int. Cl.[4] ..... B21D 22/00

[52] U.S. Cl. ..... 72/56; 72/342; 72/364

[58] Field of Search ..... 72/56, 342, 364, 352, 72/360

[56] References Cited

U.S. PATENT DOCUMENTS 3,519,503 7/1970 Moore ..... 148/11.5 F 4,412,872 11/1983 Albrecht ..... 148/11.5 F 4,415,375 11/1983 Lederich ..... 148/11.5 F 4,482,398 11/1984 Eylon ..... 148/127 B 4,499,156 2/1985 Smith ..... 148/11.5 F

*Primary Examiner*—Leon Gilden

*Attorney, Agent, or Firm*—Stanley L. Tate

[57] ABSTRACT

A method of fabricating articles from precipitation hardening aluminum alloys wherein the alloy is thermomechanically treated to control the characteristics of its microstructure before forging occurs in hot dies in an isothermal condition so that deformation occurs at a minimum strain rate. The forging temperature is above the solutionizing temperature of the alloy being forged.

9 Claims, 7 Drawing Figures

ISOTHERMAL FORGING METHOD

TECHNICAL FIELD

This invention relates in general to metal processing and in particular to a method of forging high strength, precipitation hardening aluminum alloys under controlled conditions of prior processing temperature and pressure which cause the alloys to exhibit characteristics of superplasticity during forging.

BACKGROUND ART

Conventional hot forging of iron, nickel, titanium and aluminum alloys exploits the characteristic common to all metallic materials that resistance to deformation decreases rapidly with increasing temperature and consequently, for a given forging installation, larger diameter blanks can be formed if the workpiece temperature is increased. This generalization, however, is limited by a number of natural factors: (1) the temperature at which the alloy begins to melt; (2) possible phase transformations which can lead to deterioration in the properties of the finished product; (3) the poor workability of many high temperature materials such as some super alloys; (4) changes in temperature during the deformation process as a result of heat transfer from the hot workpiece to a relatively cold forging die set; and (5) the stresses to which the tooling may be safely subjected.

U.S. Pat. No. 3,519,503 describes a method of forging high strength, difficult to forge alloys by placing them in a temporary condition of low strength and high ductility, In the U.S. Pat. No. 3,519,503 method the alloy being forged must undergo a series of heat treatments to return it to a high strength condition after forging. The U.S. Pat. No. 3,519,503 method requires that the alloy have a fine grain structure of less than 35 microns during forging, but to achieve the desired high strength and high temperature characteristics in the forged article the grain structure must be altered by a heat treatment which will cause the grain size of the forged article matrix to increase significantly. The method disclosed and claimed in U.S. Pat. No. 3,519,503 is directed to processing high strength, high temperature, difficult to forge titanium and nickel super alloys. Similar processing techniques are also discussed in "Isothermal Forming a Low Cost Method of Precision Forging" *Engineering* (July 1979); "Superplastic Behavior during Compression of As-Cast Al-CU Eutectic Alloy", *Metals Technology*, p. 355, Vol. 9 (September 1982); "Precision Aluminum Forgings Trim Weight, Maintain Strength", *Machine Design* p.63, (Nov. 10, 1983); and "Precision Forging of a High Strength Superplastic Zinc-Aluminum Alloy", *Metallurgical Transactions A*, p. 1259, Vol. 9A (September 1978).

Aluminum forgings have been used in aircraft structures because aluminum provides light weight, while the grain flow of the metal in the forging imparts high strength, ductility, and resistance to impact and fatigue because it follows the contour of the shape being forged. Regardless of their advantages, conventional aluminum forgings have in recent years been losing out to advanced composites and titanium forgings in airframe specifications. Thus, it can be seen that there remains a need for more sophisticated forging techniques which will allow aluminum to regain its past position in airframe specifications, particularly in the area of near net sized parts.

DISCLOSURE OF THE INVENTION

Accordingly, it is an object of the present invention to provide a method of fabricating near net sized articles from precipitation hardening aluminum alloys.

It is also an obJect of the present invention to provide a method of fabricating near net sized articles from precipitation hardening aluminum alloys which do not include an after forging heat treatment for the purpose of causing grain growth.

The principal feature of the present invention is the provision of a unique method of forging articles from precipitation hardening aluminum alloys whereby the alloy is forged to a desired shape or configuration in hot dies at a constant forging temperature at which deformation of the alloy occurs at a desired strain rate and which is above the temperature at which substantial precipitation of the alloy constituents will occur.

Yet another feature of the present invention is the capability of controlling crystallization so that alloy constituents precipitate from solid solution in fine, evenly distributed particles whereby a microstructure forms in the forged article which consists substantially of small grains which are aligned parallel to the article surfaces.

An important advantage of the present invention is the capability of producing forged articles which require little or no machining prior to use thereby substantially reducing the raw material cost and the scrap cost of producing the article being forged.

Another important advantage of the present invention is the ability to forge near-net-shape articles at relatively low pressures.

Yet another important advantage of the present invention is the ability to forge near-net-shape articles having improved metallurgical characteristics.

In accordance with these and other obJects, features, and advantages of the present invention there is provided a method of fabricating articles from precipitation hardening aluminum alloys which comprise: thermomechanically processing the alloy to achieve a microstructure in which the grain size of the alloy does not exceed an average of twenty microns taken along the longest dimension of the grain; forging the alloy to a desired shape in hot dies at a constant forging temperature at which deformation of the alloy occurs at a desired strain rate and which is above the temperature at which substantial precipitation of the alloy constitutents will occur; heat treating the forged article to obtain optimum properties and quenching the heat treated forged article.

Also in accordance with the present invention the forging method includes the additional step of artificially aging the article at a temperature at which the alloy will undergo controlled crystallization and precipitate from solid solution to form a fine, evenly distributed precipitate which promotes the formation of a microstructure in the article which consists primarily of small grains that are aligned parallel to the surfaces of the article.

Also in accordance with the present invention the forging temperature used in the method is preferably from about 870° F. to about 970° F.

In accordance with the present invention the flow stresses applied to the alloy being forged are applied at strain rates of from about $2\times10^{-4}$ to about $1\times10^{-3}$ inch/inch per second.

In accordance with the present invention, artificial aging is carried out at a temperature of from about 240° F. to about 260° F. for from about three to about five hours after which the temperature is increased to from about 310° F. to about 320° F. for from about three to about five hours.

Also in accordance with the present invention, the alloy being forged and the forging dies are heated to a temperature of from about 870° F. to about 970° F. before the alloy is worked to ensure optimum metal flow at minimum working stress.

These and other objects, features and advantages of the present invention will become more readily apparent with a reading of the following more detailed description of the preferred embodiment in conjunction with the accompanying drawing and claims. The drawing in which like reference characters indicate corresponding parts in all views are not necessarily to scale, emphasis instead being placed on illustrating the invention.

BEST MODE OF CARRYING OUT THE INVENTION

Figure 1:
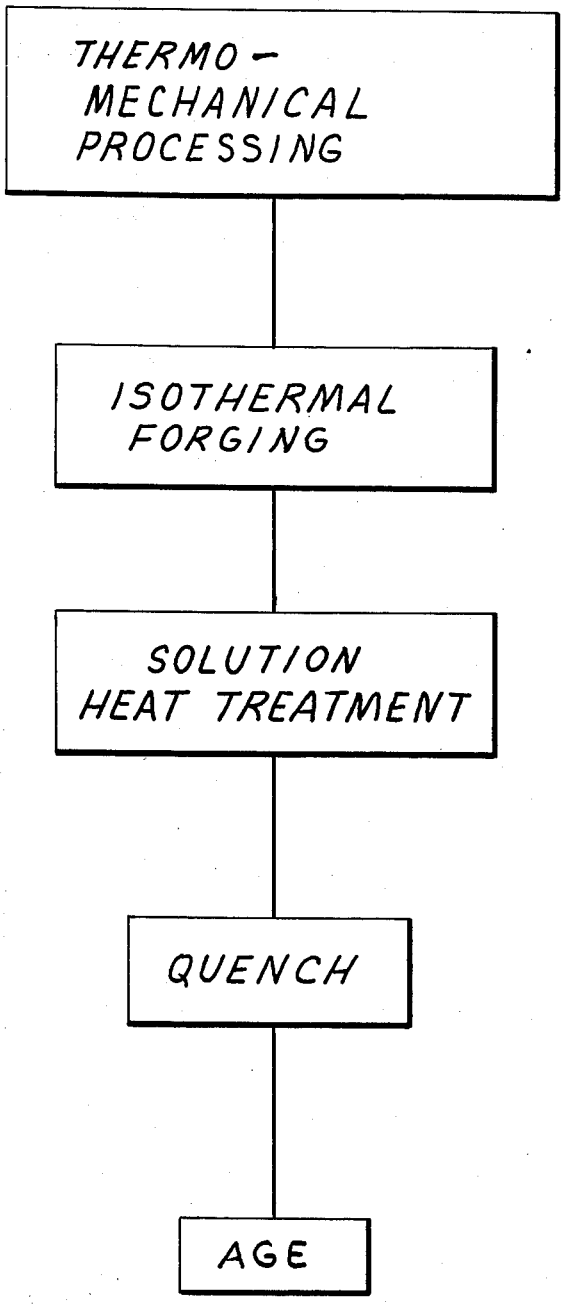
FIG. 1 is a block diagram representing the various steps of the method of the present invention.

Referring now to FIG. 1 which is a block diagram illustrating the series of steps which comprise the method of the present invention. In the initial phase of the present invention the alloy to be forged by the method of the present invention is thermomechanically processed to produce a microstructure in which the grain size is a maximum of 20 microns. The thermomechanical processing can take the form of extrusion, hot rolling controlled spray deposition or other technique that will produce an alloy blank or pre-form having a microstructure substantally consisting of fine grains of 20 microns or less. After thermomechanical processing the pre-form or blank is raised to a temperature at which the alloy exhibits super-plastic properties and is then formed at constant temperature at a minimal strain rate in preheated dies so that the small grains which make up the microstructure of the alloy do not enlarge The method of the present invention operates at lower forging pressures than standard precision forging because the alloy and dies are heated to a temperature at which the alloy has super-plastic characteristics. By taking advantage of the strain rate sensitivity of the alloy low flow stress is achieved at slow strain rates thereby resulting in a workpiece that can be forged at lower temperatures.

Generally, forging temperatures of from about 870° F. to about 970° F. have been found to produce the best results. Temperatures between 870° F. and 970° F. allow flow stresses to be applied to the alloy at a strain rate of from about $2\times10^{-4}$ inch/inch/second to about $1\times10^{-3}$ inch/inch/second.

After the alloy has been isothermally forged into the desired shape the part is solution heat treated to return any alloy constituent precipitate to solid solution and quenched rapidly to a temperature below the temperature at which substantial precipitation of alloy elements will occur. Precipitation of the alloy constituents is then forced under controlled aging conditions so that grain size of the part can be controlled. It has been found that good results can be achieved by aging forged parts at a temperature of from about 240° F. to about 260° F. for from about three to about five hours followed by aging at a temperature of from about 310° F. to about 320° F. for from about three to about five hours.

Alloys consisting of 0.10 percent max Si, 0.12 percent max Fe, from about 1.2 to about 1.9 percent Cu, 0.06 percent max Mn, from about 1.9 to about 2.6 percent Mg, from about 0.18 to about 0.25 percent Cr, from about 5.2 to about 6.2 percent Zn, 0.06 percent max Ti, with individual impurities being no more than 0.05 percent max and total impurities not exceeding 0.15 percent and the balance consisting of aluminum have been processed with good results using the method of the present invention. Also capable of being forged using the method of the present invention would be the alloy continuing a median composition of 2.0 percent copper, 2.3 percent magnesium, 0.1 percent chromium, 7.0 percent zinc, 0.2 percent cobalt, 0.2 percent zirconium and the balance being aluminum and associated trace elements.

Alloys consisting of from 0.02 to about 0.8 percent Mg, from about 3.9 to about 5.0 percent Cu, from about 0.5 to about 1.2 percent Si, from about 0.4 to about 1.2 percent Mn, 0.7 percent max Fe, 0.1 percent max Cr, 0.25 percent max An, 0.15 percent max Ti and trace elements in concentrations not exceeding 0.05 percent each max and a total trace element concentration not exceeding 0.15 percent and the balance being aluminum can be successfully processed using the method of the present invention. Also, alloys of the type containing 0.25 percent max Zn, from about 1.2 to about 1.8 percent Mg, from about 3.8 to about 4.9 percent Cu, 0.20 percent max Si, 0.3 percent max Fe, from about 0.3 to about 0.9 percent max Mn, 0.1 percent max Cr, 0.15 percent maximum Ti and trace elements in concentrations not exceeding 0.05 percent each max and a total trace element concentration not exceeding 0.15 percent and the balance being aluminum can be successfully forged using the present method.

The following example illustrates in more detail the method of the present invention and the properties of the parts which are produced using the present invention.

A fine grained (SP) 7475 Al continuous plate 0.250 inches thick was forged at 960° F. at a pressure of less than one ton per square inch to form a 0.09 inch thick, three blade stiffened panel. After forging, the part was heat treated to T61 condition. The heat treatment consisted of from about 30 to about 50 minutes at from about 875° F. to about 890° F. after which the part was heated to a temperature of from about 945° F. to about 965° F. for from about 60 to about 80 minutes resulting in a part in W condition. The part in W condition was then aged 3 to 5 hours at from about 240° F. to about 260° F. followed by aging from about 310° F. to about 320° F. The part so treated had an average conductivity of 33.9 percent IACS, an average hardness of 88.6 Kg and an elongation of from 15.0% to 16.0%.

Figure 2:
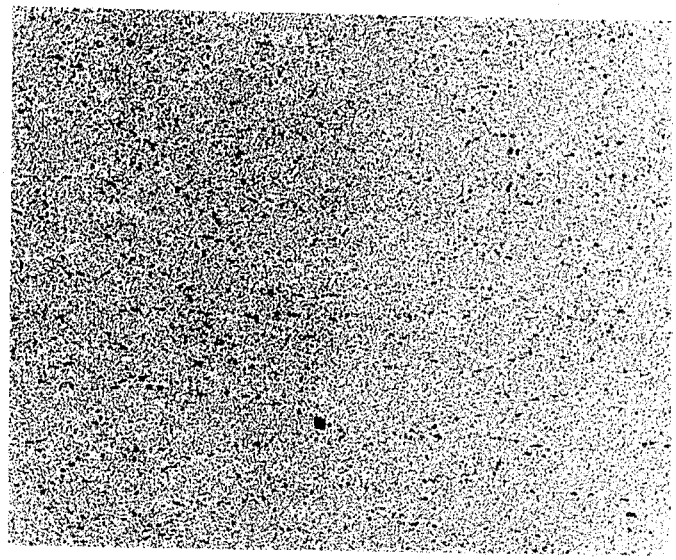
FIG. 2 is a photomicrograph illustrating pre-forging microstructure.
Figure 3:
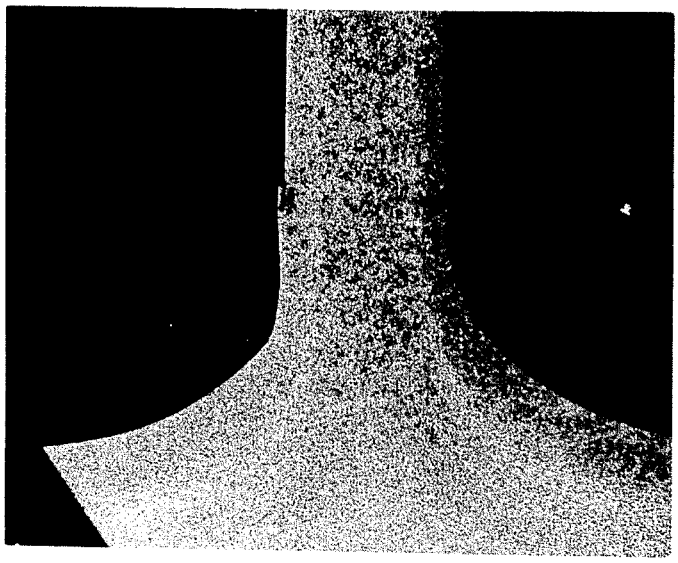
FIG. 3 is a microscopic view of a forged and heat treated part.

FIG. 2 is a photomicrograph of the microstructure of the unforged plate taken at 1000× after etching with Keller's etching solution. As can be seen, the grain structure is very fine. FIG. 3 is a microscopic view of a forged panel after heat treatment taken at 8× after a NaOH etch and $HNO_3$ desmut and also shows that the small grained microstructure has been retained.

Figure 4:
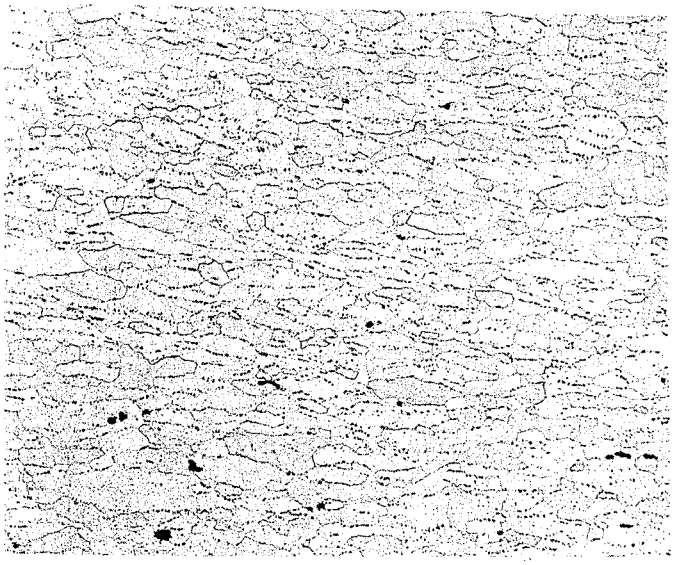
FIG. 4 is a photomicrograph of a longitudinal section of a forged part after heat treatment.
Figure 4A:
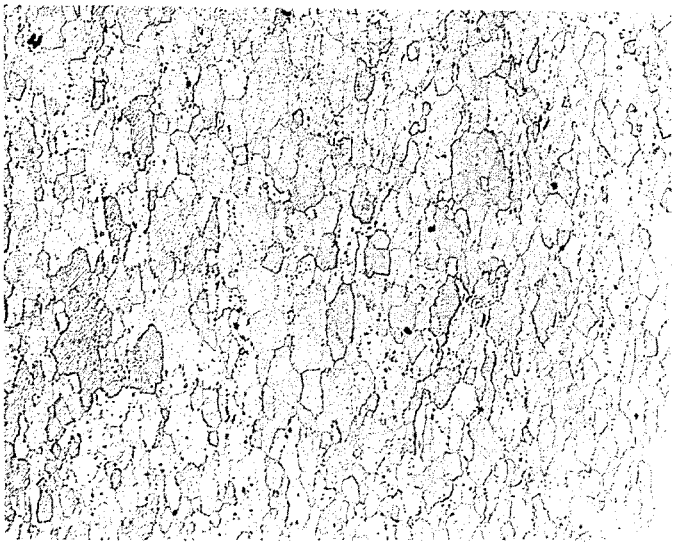
FIG. 4*a* is a photomicrograph of a transverse section of a formed panel after heat treatment.
Figure 5:
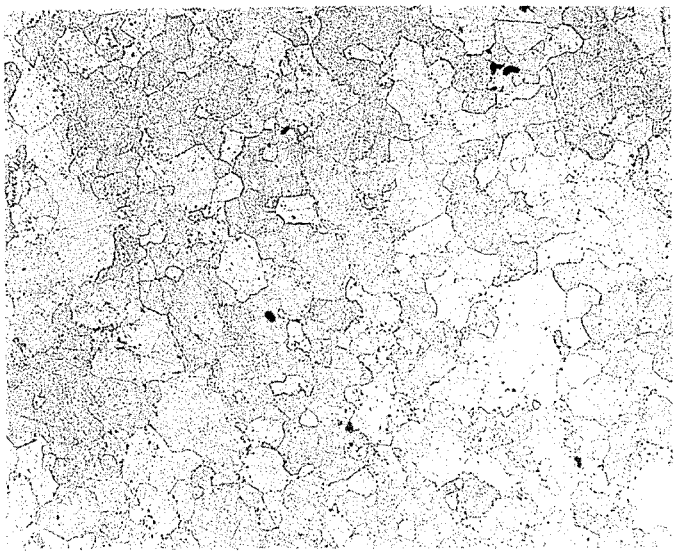
FIG. 5 is a photomicrograph of a longitudinal section of a formed blade after heat treatment.
Figure 5A:
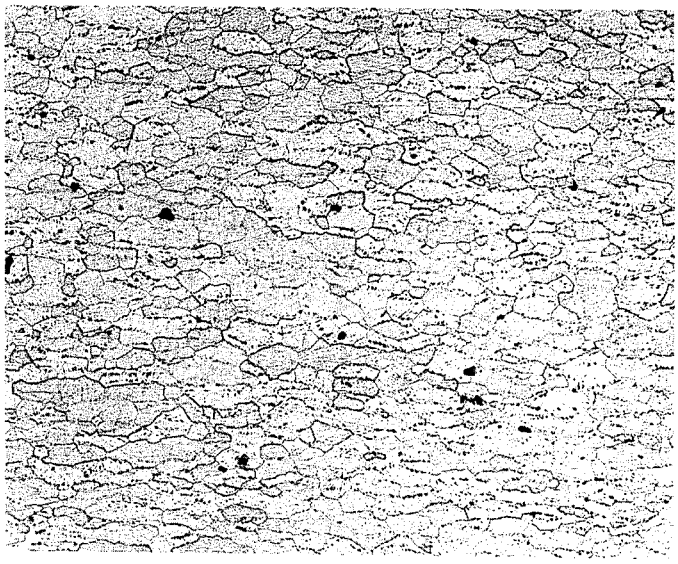
FIG. 5*a* is a photomicrograph of a transverse section of a forged blade after heat treatment.

FIG. 4 is a photomicrograph of a longitudinal section of forged panel which also shows that the fine grain structure required to maintain desired properties has been retained. FIG. 4*a* is a photomicrograph of a transverse section of forged panel demonstrating the same characteristics as FIG. 4. FIG. 5 and 5*a* are longitudinal and transverse sections of forged blades which also show that the desired small grain microstructure has been maintained.

Although the present invention has been discussed and described with primary emphasis on one preferred embodiment, it should be obvious that adaptations and modifications can be made thereto without departing from the spirit and scope of the invention.

I claim:

1. A method of fabricating articles from precipitation hardening aluminum alloys which comprise the steps of:

(a) thermomechanically processing the alloy to achieve a microstructure in which the grain size of the alloy does not exceed an average of 20 microns taken along the longest dimension of the grain;

(b) forging the alloy to a desired configuration in hot dies at a constant forging temperature at which deformation of the alloy occurs at a minimum strain rate and which is above the temperature at which substantial precipitation of the alloy constituents will occur;

(c) heat treating the forged article to obtain desired mechanical properties; and (d) reducing the temperature of the article to a temperature below the crystallization temperature of the alloy constituents at a rate at which crystallization of said alloy constituents cannot occur.

2. The method of claim 1, including the additional step of artificially aging the article at a temperature at which said alloy constituents will undergo controlled crystallization and precipitate from solid solution in fine, evenly distributed, particles thereby promoting the formation of a microstructure in the article which consists substantially of small grains which are aligned parallel to the article surfaces.

3. The method of claim 1, wherein the forging temperature is from about 870° F. to about 970° F.

4. The method of claim 1, wherein flow stresses are applied to the alloy being forged at strain rates of from about $2\times10^{-4}$ to about $1\times10^{-3}$ per second, 5. The method of claim 2, wherein the artificial aging was carried out at a temperatue of from about 240° F. to about 260° F. for from about 3 to about 5 hours after which the aging temperature was increased to from about 310° F. to about 320° F. for from about 3 to about 5 hours.

6. The method of claim 1, further including the step of preheating the aluminum alloy and the dies to a temperature of from about 870° F. to about 970° F. before the alloy is worked to ensure optimum metal flow at minimum working stress.

7. The method of claim 1, wherein thermomechanically processing the alloy comprises forming a blank or preform by controlled spray deposition from molten metal.

8. The method of claim 1, wherein thermomechanically processing the alloy comprises extruding a blank or preform from ingot or pig.

9. The method of claim 1, wherein the thermomechanically processing the alloy comprises hot rolling a pre-form or blank from ingot or pig.

* * * * *